US008690162B2

(12) United States Patent
Chang

(10) Patent No.: US 8,690,162 B2
(45) Date of Patent: Apr. 8, 2014

(54) METAL COIL PROPELLER SHAFT SEAL FOR WATERCRAFTS INCLUDING DEEP DIVE VESSELS

(71) Applicant: Neo Mechanics Limited, Hong Kong (HK)

(72) Inventor: Kyong Tae Chang, Academy Town (KR)

(73) Assignee: Neo Mechanics Limited, Hong Kong (HK)

( * ) Notice: Subject to any disclaimer, the term of this patent is extended or adjusted under 35 U.S.C. 154(b) by 0 days.

(21) Appl. No.: 13/649,124

(22) Filed: Oct. 11, 2012

(65) Prior Publication Data

US 2013/0300069 A1 Nov. 14, 2013

(30) Foreign Application Priority Data

May 14, 2012 (KR) ..... 20-2012-0003965

(51) Int. Cl.
*F16J 15/02* (2006.01)

(52) U.S. Cl.
USPC ..... 277/633; 277/650; 277/654

(58) Field of Classification Search
USPC ..... 277/628, 633, 637, 650, 654
See application file for complete search history.

(56) References Cited

U.S. PATENT DOCUMENTS 3,185,489 A * 5/1965 Klinger-Lohr ..... 277/399
6,561,519 B1 * 5/2003 Frese et al. ..... 277/549

FOREIGN PATENT DOCUMENTS

KR 100688250 B1 2/2007

* cited by examiner

*Primary Examiner* — Gilbert Lee
(74) *Attorney, Agent, or Firm* — Ella Cheong Hong Kong; Sam T. Yip

(57) ABSTRACT

A propeller shaft seal for sealing a propeller shaft in a stern tube, comprising a bi-direction rotational sealing body being fitted within the stern tube and wrapped around the propeller shaft in its axial direction; wherein the bi-direction rotational sealing body comprising two metallic helical coils stacking together in a way that is mirroring each other; wherein the first and second metallic helical coils being constructed from helically coiled metal tapes of varying widths linked together and coiled into rings and with the rings tightly bounded; and wherein at any one time during operation, a rotational direction of the propeller shaft is same as coiling direction of one of the two metallic helical coils but opposite to that of the other of the two metallic helical coils.

2 Claims, 6 Drawing Sheets

-- PRIOR ART --

-- PRIOR ART --

-- PRIOR ART --

-- PRIOR ART --

METAL COIL PROPELLER SHAFT SEAL FOR WATERCRAFTS INCLUDING DEEP DIVE VESSELS

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

CLAIM FOR FOREIGN PRIORITY

This application claims priority under 35 U.S.C. §119 to the Korea Patent Application No. 20-2012-0003965, filed May 14, 2012, the disclosure of which is incorporated herein by reference in its entirety.

CROSS-REFERENCES TO RELATED APPLICATIONS

This application is related to the Korea Patent No. 100688250, filed Apr. 7, 2006 and issued Feb. 22, 2007, the disclosure of which is incorporated herein by reference in its entirety.

FIELD OF THE INVENTION

The presently claimed invention relates generally to the mechanics of propellers in watercrafts including sea surface vessels and deep dive sea vessels.

BACKGROUND

The propeller of a vessel has a shaft extended from the engine at one end and penetrates the body of the vessel at the other end, protruding out of the vessel body. From the difference in pressure between the inside of the vessel and the outside water which the vessel is submerged within, and from the forward thrusting force generated from the rotation of the propeller, a mechanism preventing water incursion through the gap in between the propeller shaft and the vessel hull at the propeller shaft-vessel body penetration point is required.

The presently claimed invention provides an apparatus that is a propeller shaft seal for completely preventing water incursion through the gap existing around the propeller shaft at the propeller shaft-vessel body penetration.

The traditional method of preventing water incursion through the gap between the hull and the propeller shaft of a vessel is described as follows. First, a stern tube is fixed in the hull of the vessel. Then, a pipe called stern tube bearing is installed inside the stern tube. The propeller shaft is inserted into the stern tube bearing prior to use. The propeller shaft and the stern tube bearing have lengths of more than three times the diameter of the propeller shaft. The sealing function is achieved by extending the route of incurred water flowing into the gap between the stern tube and the propeller shaft. The resistive force against the incurred water flow reinforces the sealing function. Lubricant is forcefully injected into the gap, mixing with the flow of the incurred water flowing through the pipe for providing cooling and lubricating functions. Lip seals are inserted into both ends of the stern tube bearing in layers to prevent the lubricant and the incurred water overflowing into inside of the vessel. Lastly, the mixture of the incurred water and the lubricant is collected in a container and the lubricant is recycled after separating the lubricant from the incurred water using an oil-water separator.

The abovementioned traditional method is used because there has not been better sealing device that can be used for sealing propeller shafts in vessels. Moreover, such traditional propeller shaft sealing method is inadequate for use in deep-water diving vessels. First, the rubber-made lip seals are inappropriate for vessels sailing in cold waters due to the effect of rubber embrittlement that causes fractures. Thus, the mechanical strength and sealing performance of the lip seals decrease under extreme low and high temperatures. Second, the rubber-made lip seals are also inappropriate for deepwater dives due extrusion at high pressure that causes fractures. Furthermore, as stern tube bearings are not of a rolling type but of a sliding type, they feature high friction loss and short lifecycles, along with a host of other shortcomings, such as high maintenance cost, large lubricant consumption, etc.

Underwater pressure increases by one bar for every ten-meter increment in water depth in either ocean or fresh water bodies. For military submarines and industrial submarines, a considerable amount of researches has been conducted addressing issues on rotational sealing of propeller shafts. These researches are in line with the technological development in increasing the strength of vessel hulls with the goal of enabling deeper and deeper submarine dives.

One of the issues on rotational sealing of propeller shafts is that the synthetic resin lip seals lose their sealing functions at temperatures below −30° C., such as those within the Arctic Circle, due to loss of elasticity. Overtime under the exposure of extreme low temperature, the synthetic resin lip seals break into small pieces and fall apart from the propeller shafts. This issue has become more profound recently as a significant volume of ice has been lost, making new shipping routes through the Arctic Circle possible.

Another issue is that many diverse types of minerals, which can be found in coastal areas and continental shelves, are spread across the seafloors at different depths ranging from 200 to 2000 meters below sea level. Some of these minerals are exposed on the seafloor surfaces as in the case of manganese nodules. Some others can be found by digging lightly into the seafloor as in the case of methane-hydrate, which is also dubbed "burning ice". For these reasons, the perfect sealing of propeller shafts has become the utmost important technological pursuit in the marine industry.

There is one propeller shaft sealing device that is based on a rotational sealing technique described in the Korea Patent No. 100688250. One embodiment of this propeller shaft sealing device is a metallic tube made of helically coiled metal tapes and is designed to seal rotating bodies using metallic points with rubber-like radial flexibility. This propeller shaft sealing device achieves perfect sealing performance even in deepwater dives and in low temperature waters, such as those in the Arctic Circle.

One drawback of the technology described in the Korea Patent No. 100688250 is that the intended use of implemented sealing device is determined by the rotational sealing direction: clockwise or counter-clockwise. It is because the nature of helical coiling during the manufacturing process, the sealing function is enabled only for a single rotational direction of the sealing device according to the coiling direction. This limits the application of this technology to rotational machineries that do not reverse rotational directions frequently.

SUMMARY

It is an objective of the presently claimed invention to provide a design of propeller shaft sealing device that can be used in vessels under a wide range of water temperature, depth, and pressure. It is a further objective of the presently claimed invention to provide such design of propeller shaft sealing device having a rotational sealing function for both clockwise or counter-clockwise rotational directions in a single structural implementation. In another word, it is a further objective of the presently claimed invention to provide such design of propeller shaft sealing device that can seal the propeller shaft during the forward and reverse drives of the vessel.

In accordance to one embodiment of the presently claimed invention, a propeller shaft sealing device comprises of two sealing devices that are based on a rotational sealing technique described in the Korea Patent No. 100688250; wherein the two sealing devices being arranged to face each other. In implementation, a double-sized single propeller shaft sealing device amalgamated by two identical propeller shaft sealing devices facing each other.

A single metallic rotational sealing device that can be used for both rotational directions, coupled with zero-leakage sealing performance at temperatures ranging from −220 to 550° C., and at a maximum pressure of 500 bar, can be in a wide range of industrial applications beside propeller sealing.

BRIEF DESCRIPTION OF THE DRAWINGS

Embodiments of the invention are described in more detail hereinafter with reference to the drawings, in which.

DETAILED DESCRIPTION

In the following description, designs of metal coil propeller shaft seal are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

Figure 1:
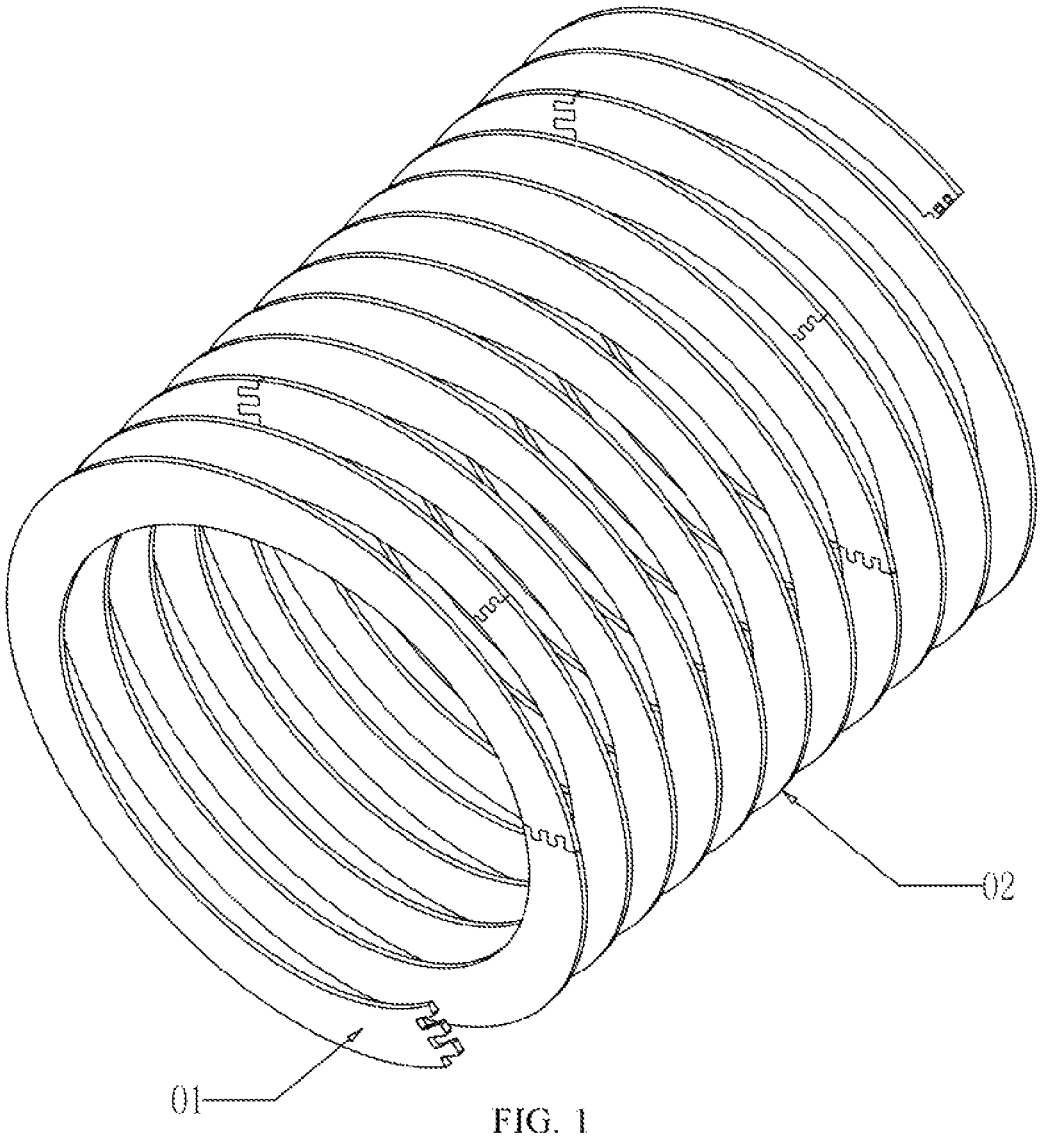
FIG. 1 shows the illustration of the structural principles of a shaft seal designed in accordance to the rotational sealing technique described in the Korea Patent No. 100688250.

FIG. 1. shows an embodiment of a metallic helical coil that can be used in the construction of a propeller shaft seal. In this embodiment, a tube 02 made of one or more helically coiled metal tapes 01 having radial elasticity equivalent to that of synthetic resin. The helically coiled metal tapes 01 are linked together and coiled into rings and with the rings tightly bounded into an elongated tube or a helical coil 02.

Figure 2:
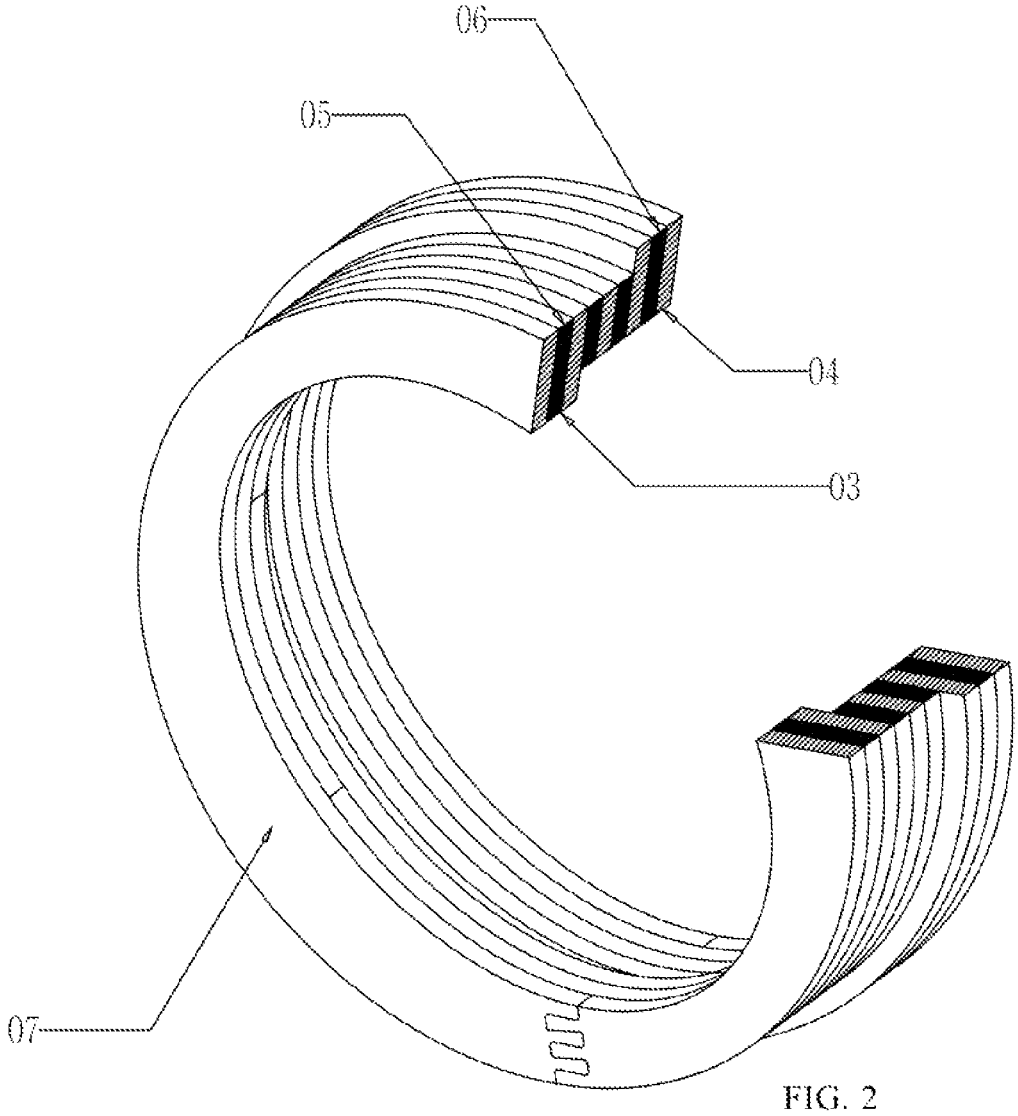
FIG. 2 shows the cross-sectional view of a shaft seal designed in accordance to the rotational sealing technique described in the Korea Patent No. 100688250.

FIG. 2 shows an embodiment of a metallic helical coil seal for sealing a shaft in a cylinder or tube constructed from helically coiled metal tapes of varying widths, in turn creating helical coil rings of varying inner and outer diameters. The varying inner diameters and outer diameters of the helical coil rings make up a shaft-contacting circle 03, a non-contacting-shaft circle 04, a cylinder-contacting circle 06, and a non-contacting-cylinder circle 05 respectively, completing the independent elastic sealing device 07.

Referring to FIG. 2. The helical coil is fitted within the cylinder or tube and wrapped around a shaft in its axial direction. The inner diameter edges of the top helical coil rings stays in proximate contact with the shaft at all time, forming the shaft-contacting circle 03. The outer diameter edges of the top helical coil rings stays out of contact with the cylinder surfaces under all circumstances due to the fact that the outer diameter edges of the top rings, which are used as the shaft-contacting circle, become the non-contacting-cylinder circle 05. As a result, the layers composed of the top helical coil rings under such conditions become shaft-sealing layers.

Still referring to FIG. 2. The inner diameter edges of the bottom helical coil rings stay out of contact with the shaft under all circumstances, forming the non-contacting-shaft circle 04. The outer diameter edges of the bottom helical coil rings stay in proximate contact with the cylinder surfaces at all time forming the cylinder-contacting circle 06. As a result, the layers composed of the bottom helical coil rings under such conditions become cylinder-sealing layers.

In addition, in the continuous coiling of the helically coiled metal tapes, as the top helical coil rings turn into the bottom helical coil rings, the transitional rings in between the non-contacting-cylinder circle 05 and the non-contacting-shaft circle 04 remain in a floating condition in which both the outer diameter edges and inner diameter edges of the transitional ring are not in contact with the shaft or cylinder. The layers composed of the transitional helical coil under such conditions serve as displacement absorption layers. Such displacement absorption layers gradually wear out whenever the sealing layers abutting on the left and right sides of the displacement absorption layers are used in preventing leakage by absorbing displacements caused by mechanical vibrations.

Therefore, these three layers each with an independent function are constructed into a single structure as the independent elastic sealing device 07.

Figure 3:
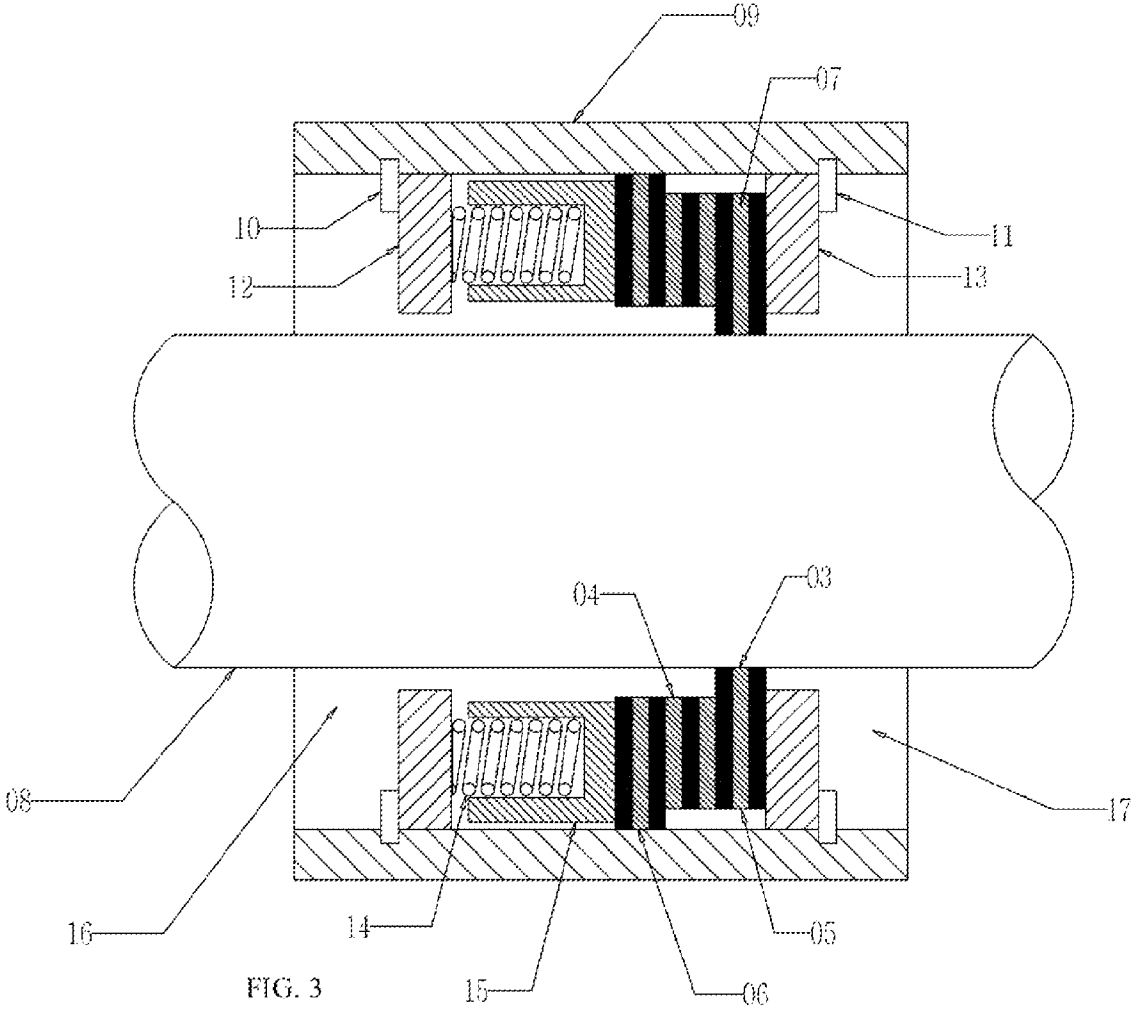
FIG. 3 shows the cross-sectional view of an exemplary machine with a shaft in a tube or cylinder installed with a shaft seal designed in accordance to the rotational sealing technique described in the Korea Patent No. 100688250.

FIG. 3 shows the cut out view of a completed machine unit by assembling the sealing device of Korea Patent No. 100688250 into the machine unit. An independent elastic sealing device 07 is assembled inside of a cylinder 09. FIG. 3 shows that the cylinder-sealing circle 06 is contacting the inner wall of the cylinder 09 and the shaft-contacting circle 03 is contacting the surface of the shaft 08 and those two floating circles, the shaft-non-contacting circle 04 and the cylinder-non-contacting circle 05 are shown kept away from both cylinder wall and shaft surface without any contacting.

A compression ring 15 has a number of small holes along the ring edge. Small compression springs 14 are inserted in each hole on the compression ring 15 to apply compression force on the independent elastic sealing device 07 to its axis direction to keep all the rings be tightly contacted each other to block leak between the rings in the independent elastic sealing device 07. Two stop rings 10 and 11 are installed to determine the location of the independent elastic sealing device 07 in the cylinder 09 and two protective rings are also installed to protect the independent elastic sealing device 07.

In this embodiment, Chamber 16 side is high pressure side and the chamber 17 side is low pressure side in this structure.

If the helical coil 02 in the FIG. 3 is wound in the right hand (clockwise) direction and if the shaft 08 starts to rotate in the same right hand (clockwise) direction, the helical coil 02 will wind up on the shaft 08 and hold the shaft 08 by the friction between helical coil 02 and the shaft 08 causing band break effect and stopping the shaft 08 from rotating at same time. If the helical coil 02 in the FIG. 3 is wound in the right hand (clockwise) direction as before but if the shaft 08 starts to rotate in the left hand (counter-clockwise) direction, which is the reverse direction of the coil winding, the helical coil 02 cannot wind up on the shaft 08 because the diameter of the helical coil 02 will be enlarged by the expansion of the wound diameter by the friction between the helical coil 02 and the shaft 08. The helical coil 02 and the shaft 08 cannot stay in contact forever as long as the shaft 08 keeps rotating in the reverse direction of the coil winding because the frictional force between the helical coil 02 and the shaft 08 spreads and pushes outward the wound up coil such that it cannot remain in contact with the shaft surface. The clearance between the helical coil 02 and shaft 08 maintains a fraction of thousandth of a millimeter as the wound up coil spring bounces back to its freestanding condition within millionths of a second after it is pushed outward by the frictional force. This extremely fine clearance between rotating shaft and the static coil provides the basic foundation of dynamic rotary seal. In other words, the extremely fine clearance that exists between the helical coil spring and the rotating shaft makes it possible to have a dynamic rotary seal. Moreover, this seal is composed of multiple ring layers and even though there could be minor leak on first layer, there are layers after layers that will block leaking as a failsafe, making an absolute-zero-leak-seal by multiple sealing layers.

However, the sealing device of Korea Patent No. 100688250 has a fatal drawback that it is usable only as one direction rotary seal, either a clockwise or counter-clockwise dynamic seal according to the direction of wound up coil in either right hand or left hand winding. The problem of such a crippled half function can clearly be solved by the presently claimed invention, by putting two same uni-directional rotary seals, either both clockwise or counter clockwise dynamic seals together in place of the single one. Two devices are set in tandem arrangement in structure, but their appearance must be shaped as mirror reflecting shape. In other words, two identical devices are constructed into one and structured as tail-head-tail sequence, which looks like two tails in a mirror reflected in location while head at the mirror center line. When the helical coil dynamic seal is constructed into tandem arrangement and in mirror reflecting arrangement, the five layers shall be in the sequence of cylinder-seal layer, absorption layer, shaft-seal layer, absorption layer, and cylinder-seal layer. In any helical coil the flow direction of two ends of a coil observed from one end is reverse direction. In other words if the flowing direction is observed at one end as right hand winding, then the flow direction of opposite end observed at the first observation end is left hand direction. Among the abovementioned five layers, if the first layer is a cylinder-seal layer, which acts as the band brake for the clockwise rotation of the seal, the fifth layer is a cylinder-seal layer, which acts as the band brake for counter-clockwise rotation of the seal, the third layer is a shaft-seal layer at the center position, which can function as a bi-direction seal as it has both clockwise and counter-clockwise band brake on both ends of the seal assembly.

Figure 4:
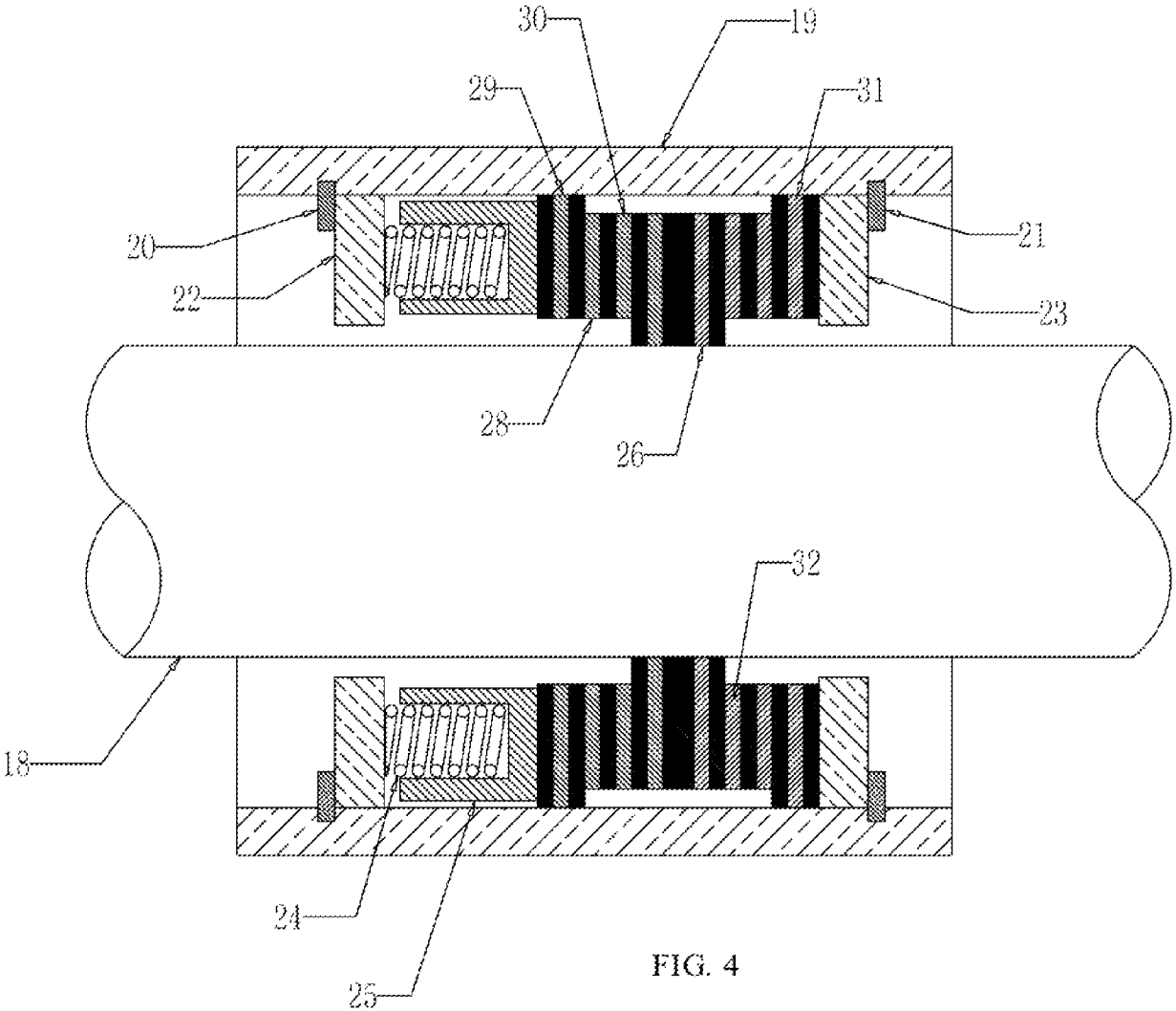
FIG. 4 shows the cross-sectional view of an exemplary machine with rotational shaft in a tube installed with a propeller shaft seal designed in accordance to one embodiment of the presently claimed invention.

Referring to FIG. 4. FIG. 4 shows the cross-sectional view of an exemplary machine with a shaft in a cylinder installed with a shaft seal having a bi-direction rotational sealing body comprising two metallic helical coils stacking and mirroring each other. The shaft-contacting circle 26 is in contact with the surface of the shaft 18, and the two divided cylinder-contacting circles 29 and 31 remain in contact with the inner surfaces of the cylinder 19. The non-contacting-shaft circle 28 and the non-contacting-cylinder circle 30 remain in floating conditions and do not come into contact with the shaft or the cylinder surface under any circumstance.

Two stop rings 20 and 21 are installed inside the cylinder 09 to fix the installation position of the bi-direction rotational sealing body 32 of the shaft seal. Two protective rings 22 and 23 are installed to protect the bi-direction rotational sealing body 32 of the shaft seal.

A compression ring 25 having a number of orifices for securing compression springs 24 compresses, by the force of the compression springs 24 in the axial direction, the bi-direction rotational sealing body 32 of the shaft seal to ensure the helical coil rings comprising the bi-direction rotational sealing body 32 of the shaft seal to be tightly bound with each other. This prevents any possible leakage from the gap between the rings.

Figure 5:
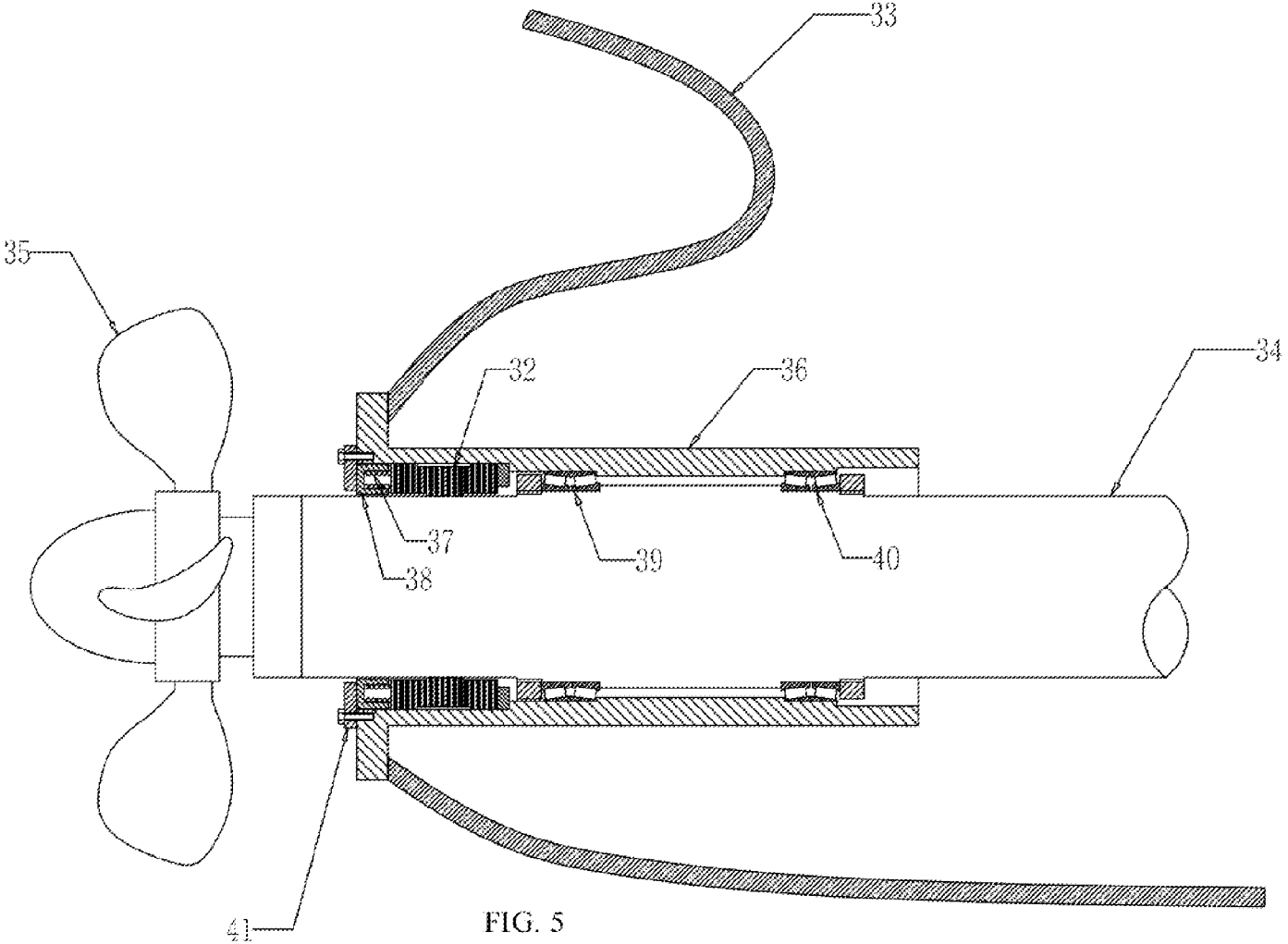
FIG. 5 shows the cross-sectional view of an exemplary propeller shaft in a stern tube installed with a propeller shaft seal designed in accordance to one embodiment of the presently claimed invention.

FIG. 5 shows the cross-sectional view of an exemplary propeller shaft in a stern tube installed with a propeller shaft seal having a bi-direction rotational sealing body comprising two metallic helical coils stacking and mirroring each other. Referring to FIG. 5. The mounting plate 41 installed on the outer side of the stern tube of a vessel 36 is designed to be detachable for repairs. The bi-direction rotational sealing body 32 can be separated from the hull when needed—in the event of an emergency for example.

Figure 6:
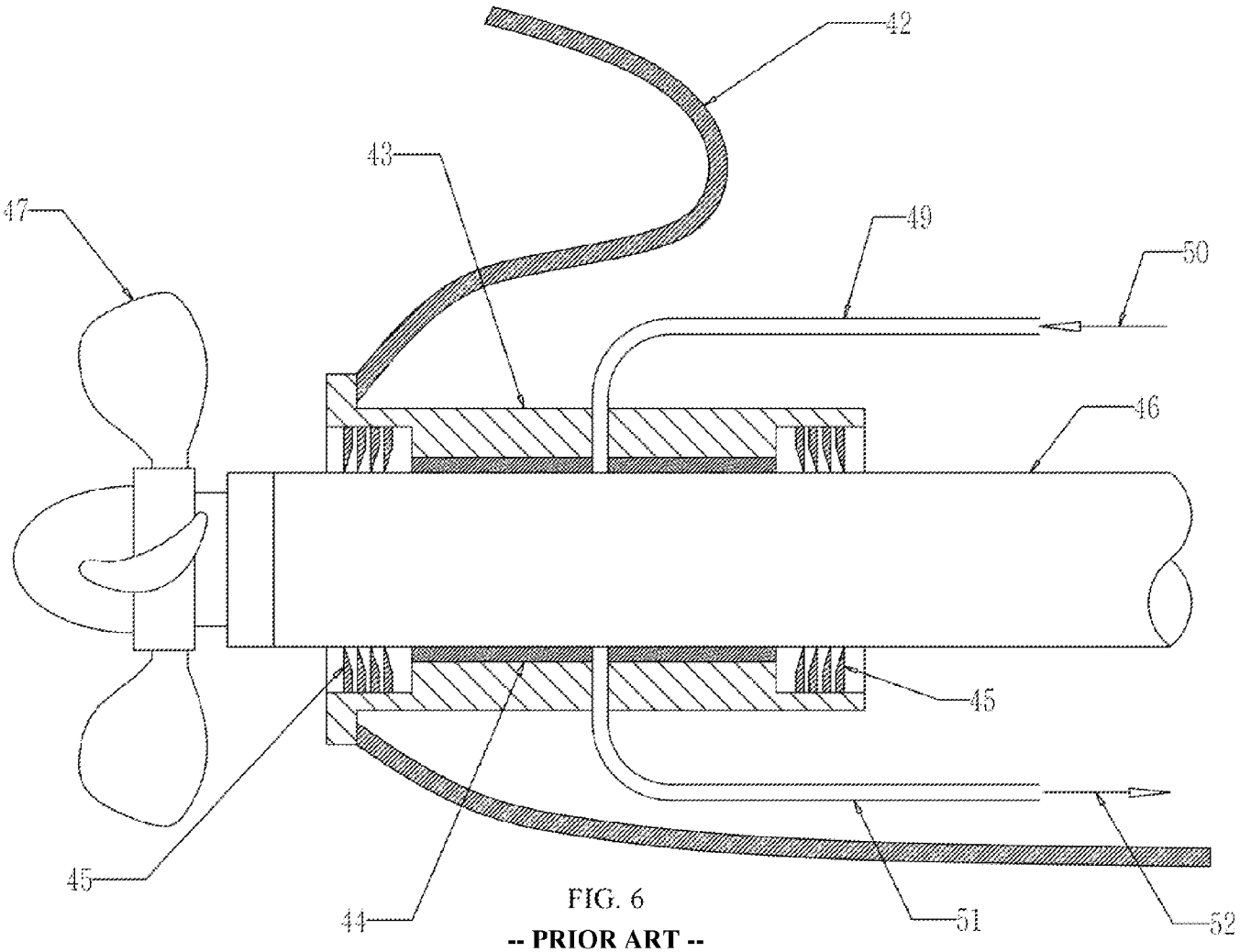
FIG. 6 shows the cross-sectional view of an exemplary propeller shaft in a stern tube installed with a conventional stern tube bearing.

FIG. 6 shows the cross-sectional view of an exemplary propeller shaft in a stern tube installed with a conventional stern tube bearing. Referring to FIG. 6. The stern tube 43 is installed inside the hull 42. The stern tube bearing 44 is temporarily installed inside the stern tube 43. The propeller shaft 46 is installed inside the stern tube bearing 44, penetrates the hull 42, and protrudes out of the vessel. The propeller 47, which generates thrust that pushes forward the vessel when rotating in water, is installed at the end of the propeller shaft 46. The lubricant inlet pipe 49 and the lubricant outlet pipe 51 are installed in such a way connecting the stern tube 43 and the stern tube bearing 44. Lubricant is supplied via the lubricant inlet pipe 49 in the direction of arrow 51, flown through the stern tube bearing 44, and is collected via the lubricant outlet pipe 51 in the direction of arrow 52. The collected lubricant is recycled using a regeneration facility. Multi-folded lip seals 45 are installed on both ends of the stern tube bearings 44 inside the stern tube 43 in order to prevent any lubricant leakage from the stern tube 43.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A propeller shaft seal for sealing a propeller shaft in a stern tube, comprising:

a bi-direction rotational sealing body being fitted within the stern tube and wrapped around the propeller shaft in an axial direction of the propeller shaft;

wherein the bi-direction rotational sealing body comprising a first and a second metallic helical coils stacking together in a way that is mirroring each other;

wherein the stacked first and second metallic helical coils being constructed from helically coiled metal tapes of varying widths linked together and coiled into rings and with the rings tightly bounded;

wherein the rings in the stacked first and second metallic helical coils having varying inner and outer diameters comprising, starting from one end of the bi-direction rotational sealing body:

a first cylinder-sealing circle, wherein outer diameter edges of the one or more rings within the first cylinder-sealing circle stay in proximate contact with wall of the stern tube;

a first shaft-non-contacting circle;

a first cylinder-non-contacting circle;

a shaft-contacting circle, wherein inner diameter edges of the one or more rings forming the shaft-contacting circle stay in proximate contact with surface of the propeller shaft;

a second cylinder-non-contacting circle;

a second shaft-non-contacting circle; and a second cylinder-sealing circle, wherein outer diameter edges of the one or more rings within the second cylinder-sealing circle stay in proximate contact with wall of the stern tube;

wherein inner and outer diameter edges of the one or more rings between the first cylinder-non-contacting circle and the first shaft-non-contacting circle remain in a floating condition in which both inner and outer diameter edges of the one or more rings between the first cylinder-non-contacting circle and the first shaft-non-contacting circle stay out of contact with surface of the propeller shaft and wall of the stern tube;

wherein inner and outer diameter edges of the one or more rings between the second cylinder-non-contacting circle and the second shaft-non-contacting circle remain in a floating condition in which both inner and outer diameter edges of the one or more rings between the second cylinder-non-contacting circle and the second shaft-non-contacting circle stay out of contact with surface of the propeller shaft and wall of the stern tube;

wherein the one or more rings within the first cylinder-sealing circle form a first cylinder-seal layer; the one or more rings between the first cylinder-non-contacting circle and the first shaft-non-contacting circle form a first absorption layer; the one or more rings within the shaft-contacting circle form a shaft-seal layer; the one or more rings between the second cylinder-non-contacting circle and the second shaft-non-contacting circle form a second absorption layer; and the one or more rings within the second cylinder-sealing circle form a second cylinder-seal layer; and wherein at any one time during operation, a rotational direction of the propeller shaft is same as coiling direction of one of the first and second metallic helical coils but opposite to that of the other of the two metallic helical coils.

2. A propeller shaft seal for sealing a propeller shaft in a stern tube, comprising:

a bi-direction rotational sealing body being fitted within the stern tube and wrapped around the propeller shaft in an axial direction of the propeller shaft;

wherein the bi-direction rotational sealing body comprising a first and a second metallic helical coils stacking together in a way that is mirroring each other;

wherein the stacked first and second metallic helical coils being constructed from helically coiled metal tapes of varying widths linked together and coiled into rings and with the rings tightly bounded;

wherein the rings in the stacked first and second metallic helical coils having varying inner and outer diameters comprising, starting from one end of the bi-direction rotational sealing body:

a first shaft-contacting circle, wherein inner diameter edges of the one or more rings forming the first shaft-contacting circle stay in proximate contact with surface of the propeller shaft;

a first cylinder-non-contacting circle;

a first shaft-non-contacting circle;

a cylinder-sealing circle, wherein outer diameter edges of the one or more rings within the cylinder-sealing circle stay in proximate contact with wall of the stern tube;

a second shaft-non-contacting circle; and a second cylinder-non-contacting circle;

a second shaft-contacting circle, wherein inner diameter edges of the one or more rings forming the second shaft-contacting circle stay in proximate contact with surface of the propeller shaft;

wherein inner and outer diameter edges of the one or more rings between the first cylinder-non-contacting circle and the first shaft-non-contacting circle remain in a floating condition in which both inner and outer diameter edges of the one or more rings between the first cylinder-non-contacting circle and the first shaft-non-contacting circle stay out of contact with surface of the propeller shaft and wall of the stern tube;

wherein inner and outer diameter edges of the one or more rings between the second cylinder-non-contacting circle and the second shaft-non-contacting circle remain in a floating condition in which both inner and outer diameter edges of the one or more rings between the second cylinder-non-contacting circle and the second shaft-non-contacting circle stay out of contact with surface of the propeller shaft and wall of the stern tube;

wherein the one or more rings within the first shaft-contacting circle form a first shaft-seal layer; the one or more rings between the first cylinder-non-contacting circle and the first shaft-non-contacting circle form a first absorption layer; the one or more rings within the cylinder-sealing circle form a cylinder-seal layer; the one or more rings between the second cylinder-non-contacting circle and the second shaft-non-contacting circle form a second absorption layer; and the one or more rings within the second shaft-contacting circle form a second shaft-seal layer; and wherein at any one time during operation, a rotational direction of the propeller shaft is same as coiling direction of one of the first and second metallic helical coils but opposite to that of the other of the two metallic helical coils.

* * * * *